US009179755B2

(12) United States Patent
Little et al.

(10) Patent No.: US 9,179,755 B2
(45) Date of Patent: Nov. 10, 2015

(54) ASSEMBLY FOR DISPENSING A COSMETIC STICK

(71) Applicant: MoreStick, LLC, Henderson, NV (US)

(72) Inventors: DeBorah Ann Little, Syracuse, NY (US); David Thornton Middleton, Jr., Skaneateles, NY (US)

(73) Assignee: MoreStick, LLC, Henderson, NV (US)

( * ) Notice: Subject to any disclaimer, the term of this patent is extended or adjusted under 35 U.S.C. 154(b) by 85 days.

(21) Appl. No.: 14/272,306

(22) Filed: May 7, 2014

(65) Prior Publication Data

US 2014/0334862 A1 Nov. 13, 2014

Related U.S. Application Data

(60) Provisional application No. 61/820,409, filed on May 7, 2013.

(51) Int. Cl.
*A45D 40/06* (2006.01)

(52) U.S. Cl.
CPC ..... *A45D 40/06* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,419,526 | A | 4/1947 | Anderson | |
| 3,343,668 | A | 9/1967 | Politzer | |
| 4,770,556 | A | 9/1988 | Ackermann et al. | |
| 4,961,663 | A * | 10/1990 | Iwamoto | A45D 40/06 401/78 |
| 5,468,084 | A | 11/1995 | Boninsegni et al. | |
| 5,893,672 | A | 4/1999 | Erickson | |
| 5,899,620 | A | 5/1999 | Pierpont | |
| 5,979,468 | A | 11/1999 | Blake, III | |
| 5,988,919 | A | 11/1999 | Kuo | |
| 6,004,054 | A | 12/1999 | Wei-Pin | |
| 6,293,721 | B1 * | 9/2001 | Bow | A45D 40/06 401/78 |
| 6,343,886 | B2 | 2/2002 | Shochat | |
| 7,112,002 | B2 | 9/2006 | Susini et al. | |
| 7,637,371 | B2 | 12/2009 | Kang | |
| 7,753,608 | B2 | 7/2010 | Hsing | |
| 7,866,905 | B2 | 1/2011 | Mihara et al. | |
| 8,152,398 | B2 | 4/2012 | Kim et al. | |
| 8,210,347 | B2 | 7/2012 | McLaughlin | |

FOREIGN PATENT DOCUMENTS

| | | | |
|---|---|---|---|
| WO | WO-2013086669 | A1 | 6/2013 |
| WO | WO-2014182846 | A1 | 11/2014 |
| WO | WO-2014/182846 | A4 | 1/2015 |

OTHER PUBLICATIONS

International Search Report & Written Opinion, Application No. PCT/US2014/037194, Applicant, MoreStick, LLC Mailed Sep. 5, 2014, 16 pages.
Article 19 Amendment filed Nov. 5, 2014, 22 pages.
PCT/IB/346, Notification Concerning the filing of amendment of the claims, Article 19 Accepted, Mailed Dec. 1, 2014, 1 page.

* cited by examiner

*Primary Examiner* — David Walczak
(74) *Attorney, Agent, or Firm* — Barclay Damon, LLP

(57) ABSTRACT

An assembly for dispensing a cosmetic stick includes a housing base and an extracting tube for extracting the remaining portion of a cosmetic stick from another dispenser. The assembly also includes a plunger with a plunger cap that moves within the extracting tube when the housing base is rotated with respect to the extracting tube to push the cosmetic stick through the extracting tube until a portion of the cosmetic stick is exposed at a top end of the top section of the extracting tube.

13 Claims, 12 Drawing Sheets

ASSEMBLY FOR DISPENSING A COSMETIC STICK

CROSS-REFERENCE TO RELATED APPLICATIONS

This application claims the benefit of and priority to U.S. Provisional Patent Application Ser. No. 61/820,409, filed May 7, 2013, and entitled "APPARATUS AND METHOD TO DISPENSE A MAKEUP STICK," the entirety of which is incorporated herein by reference.

BACKGROUND OF THE INVENTION

The subject matter disclosed herein relates to an assembly for dispensing a cosmetic stick (e.g., lipstick, lip balm, deodorant, etc.).

A conventional dispenser for dispensing a cosmetic stick includes a receptacle into which the base portion of the cosmetic stick is inserted. The receptacle (e.g., a cup) is installed in a tubular dispenser that allows the receptacle and cosmetic stick to move upward and downward within the tubular dispenser, enabling a portion of the cosmetic stick to be elevated beyond the top of the tubular dispenser for application and then retracted back within the tubular dispenser for storage.

In these conventional dispensers, the base portion of the cosmetic stick, including the portion that is inserted into and surrounded by the receptacle, cannot be elevated beyond the top of the tubular dispenser for application. Accordingly, that base portion of the cosmetic stick remains within the tubular dispenser and cannot be easily accessed for application. This results in the base portion of the cosmetic stick being wasted (sometimes as much as 25% to 30% of the overall length of the cosmetic stick).

In addition to wasting the base portion of the cosmetic stick, the conventional dispenser results in the dispenser not being available for reuse. This is especially disadvantageous when a decorative dispenser is used. In addition, the conventional dispensers are not easily cleaned or disassembled if reuse was desired.

The discussion above is merely provided for general background information and is not intended to be used as an aid in determining the scope of the claimed subject matter.

BRIEF DESCRIPTION OF THE INVENTION

An assembly for dispensing a cosmetic stick includes a housing base and an extracting tube for extracting the remaining portion of a cosmetic stick from another dispenser. The assembly also includes a plunger with a plunger cap that moves within the extracting tube when the housing base is rotated with respect to the extracting tube to push the cosmetic stick through the extracting tube until a portion of the cosmetic stick is exposed at a top end of the top section of the extracting tube. An advantage that may be realized in the practice of some disclosed embodiments of the assembly is that the remaining and unused portions of cosmetic sticks can be removed and then used rather than discarded and wasted.

In one embodiment, an assembly for dispensing a cosmetic stick is disclosed. The assembly comprises a housing base comprising a housing base wall forming a perimeter of the housing base, the housing base wall comprising a top section, a bottom section, an inner surface, and an outer surface, a guide tube extending along a longitudinal axis of the assembly, the guide tube comprising a top section and a bottom section, a first guide tube opening located at a top end of the top section of the guide tube, and a first guide tube slot extending longitudinally along at least a portion of the guide tube, a housing base floor extending from the bottom section of the guide tube to the bottom section of the housing base wall, wherein a housing base cavity is formed between the inner surface of the housing base wall, the housing base floor, and the guide tube. The assembly also comprises an extracting tube at least partially located in the housing base cavity and extending along the longitudinal axis of the assembly, the extracting tube comprising an inner surface and an outer surface, a top section and a bottom section, wherein the inner surface of the bottom section of the extracting tube surrounds at least a portion of the first guide tube slot of the guide tube, and a first guide groove extending helically along the inner surface of at least a portion of the bottom section of the extracting tube, wherein the extracting tube is rotatably engaged with the housing base, and wherein the extracting tube is configured to receive the cosmetic stick. The assembly further comprises a plunger at least partially surrounded by the guide tube and extending along the longitudinal axis of the assembly, the plunger comprising a plunger stem comprising a top section and a bottom section, wherein the bottom section of the plunger stem extends longitudinally through at least a portion of the guide tube, and wherein a top end of the top section of the plunger stem extends through the first guide tube opening located at the top end of the top section of the guide tube, a plunger cap comprising a top surface and a bottom surface, wherein the plunger cap is located outside of the guide tube at the top end of the top section of the plunger stem and is surrounded by the inner surface of the top section of the extracting tube, and a first plunger guide pin extending radially from the bottom section of the plunger stem through the first guide tube slot of the guide tube and into the first guide groove of the extracting tube, wherein the first plunger guide pin is configured to move within the first guide tube slot of the guide tube as the first plunger guide pin moves along the first guide groove extending helically along the inner surface of the bottom section of the extracting tube when the housing base is rotated with respect to the extracting tube, and wherein the movement of the first plunger guide pin is configured to move the plunger stem and the plunger cap longitudinally within the extracting tube to push the cosmetic stick through the extracting tube until a portion of the cosmetic stick is exposed at a top end of the top section of the extracting tube.

In another embodiment, the assembly further comprises a housing cap surrounding at least a portion of the extracting tube, the housing cap comprising a housing cap wall forming a perimeter of the housing cap, the housing cap wall comprising a top section, a bottom section, an inner surface, and an outer surface, wherein an extracting tool receiving opening is formed in the bottom section of the housing cap wall, and an extracting tool comprising a probe stick comprising a distal section and a proximal section, and a gripping section comprising an inner section and an outer section, wherein a gripping section channel is formed between the inner section and the outer section, and wherein the gripping section channel is configured to fit and engage with the extracting tool receiving opening formed in the bottom section of the housing cap wall, wherein the probe stick extends within the housing cap from the inner section of the gripping section.

In yet another embodiment, the guide tube further comprises a second guide tube slot extending longitudinally along at least a portion of the guide tube, the extracting tube further comprises a second guide groove extending helically along the inner surface of at least a portion of the bottom section of the extracting tube, the plunger further comprises a second plunger guide pin extending radially from the bottom section of the plunger stem through the second guide tube slot of the guide tube and into the second guide groove of the extracting tube, the second plunger guide pin is configured to move within the second guide tube slot of the guide tube as the second plunger guide pin moves along the second guide groove extending helically along the inner surface of the bottom section of the extracting tube when the housing base is rotated with respect to the extracting tube, and the movement of the second plunger guide pin is configured to move the plunger stem and the plunger cap longitudinally within the extracting tube to push the cosmetic stick through the extracting tube until a portion of the cosmetic stick is exposed at a top end of the top section of the extracting tube.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

An assembly for dispensing a cosmetic stick is disclosed. The assembly includes a housing base and an extracting tube for extracting the remaining portion of a cosmetic stick from another dispenser. The assembly also includes a plunger with a plunger cap that moves within the extracting tube when the housing base is rotated with respect to the extracting tube to push the cosmetic stick through the extracting tube until a portion of the cosmetic stick is exposed at a top end of the top section of the extracting tube. An advantage that may be realized in the practice of some disclosed embodiments of the assembly is that the remaining and unused portions of cosmetic sticks can be removed and then used rather than discarded and wasted.

Figure 1:
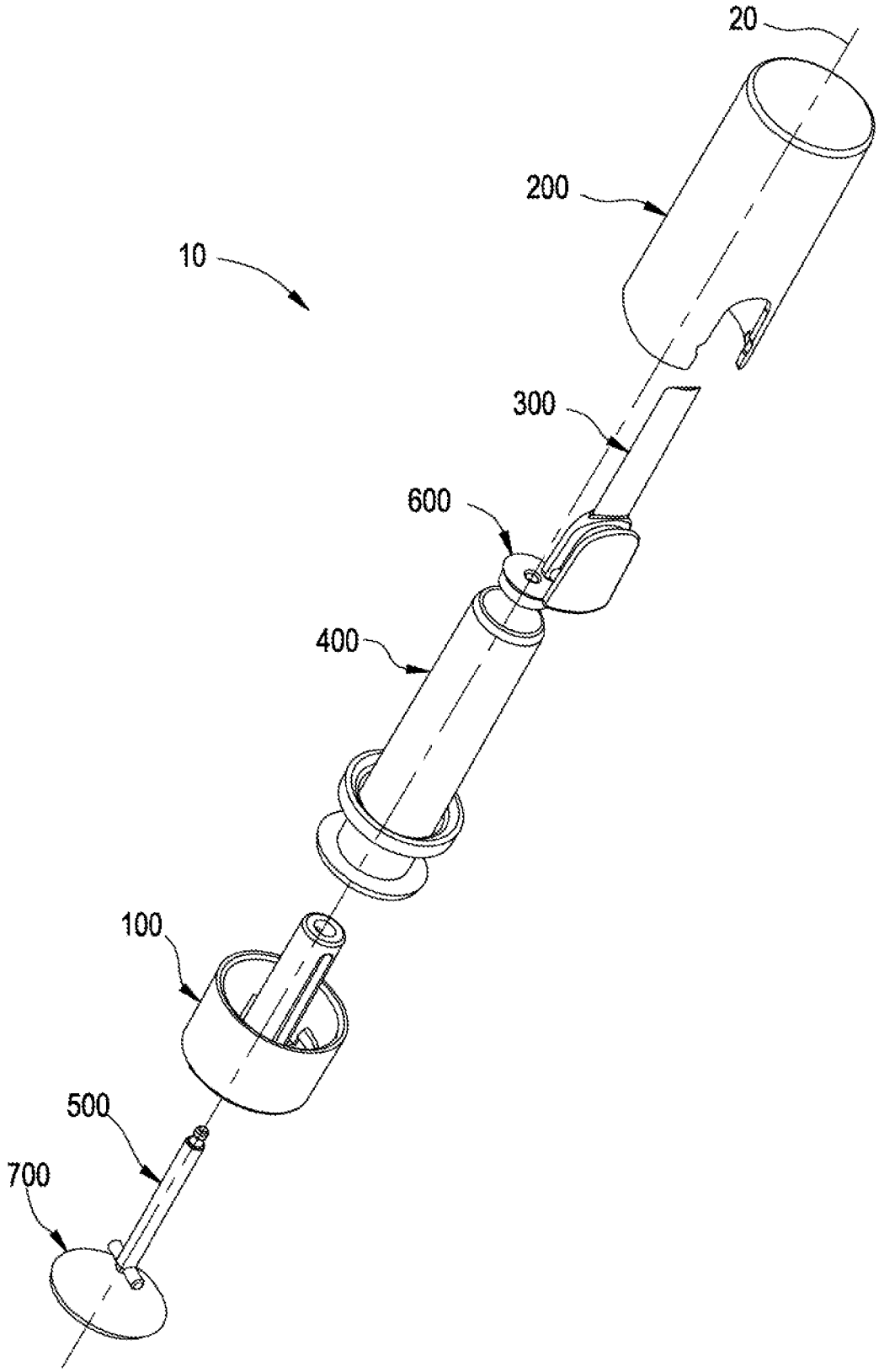
FIG. 1 is an exploded view of an exemplary dispensing assembly.
Figure 2A:
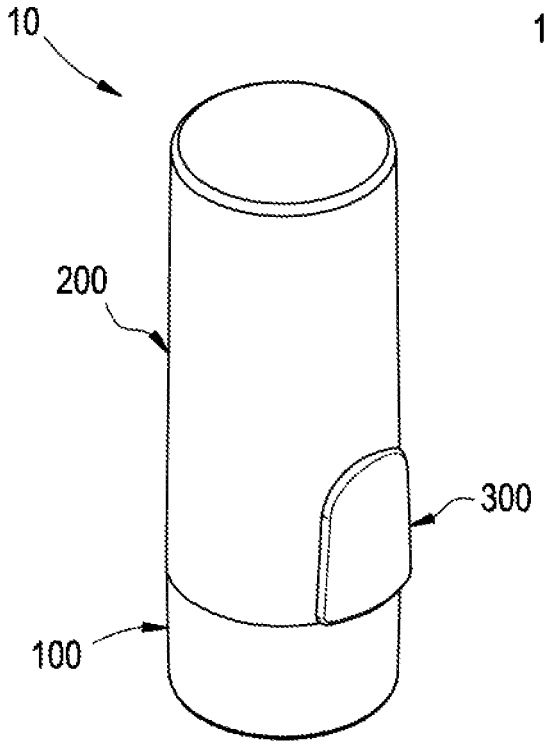
FIGS. 2A-2C are perspective (2A), side (2B), and top (2C) views of the exemplary dispensing assembly of FIG. 1.
Figure 2B:
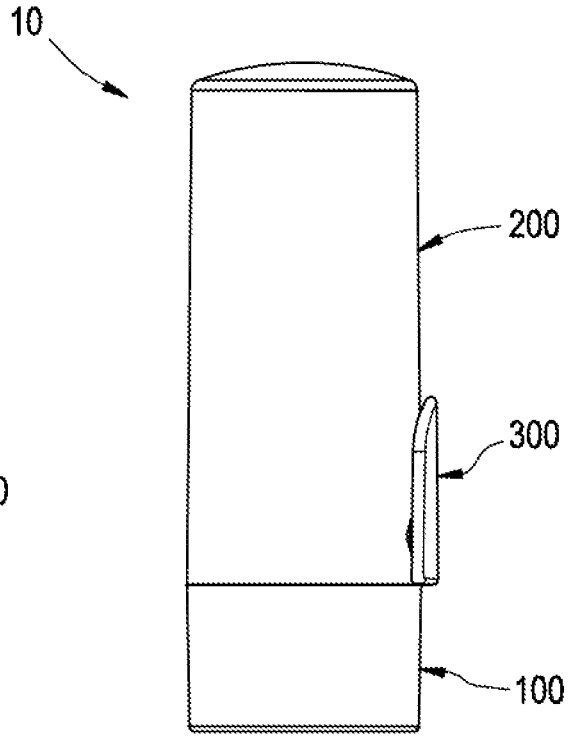
Figure 2C:
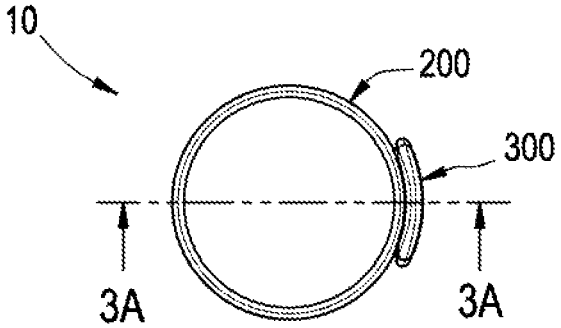
Figure 6A:
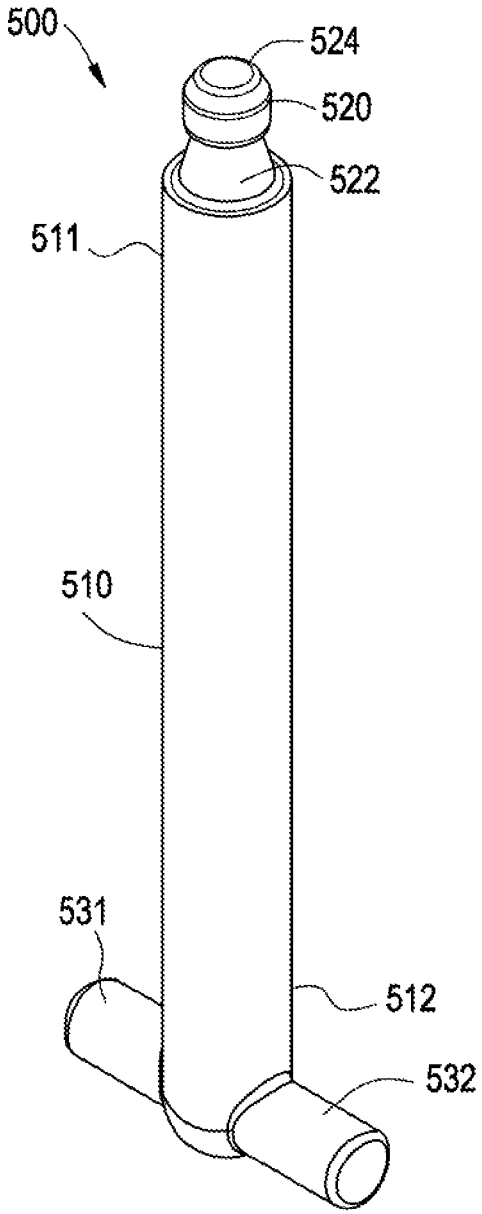
FIGS. 6A and 6B are perspective (6A) and side (6B) views of an exemplary plunger of the exemplary dispensing assembly of FIGS. 1-3B.
Figure 6B:
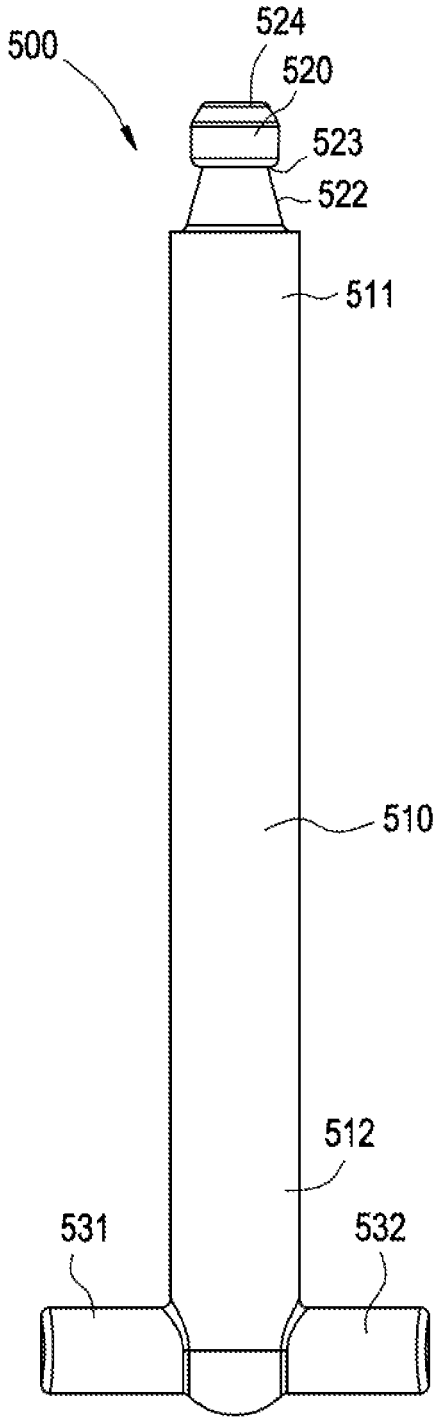
Figure 8A:
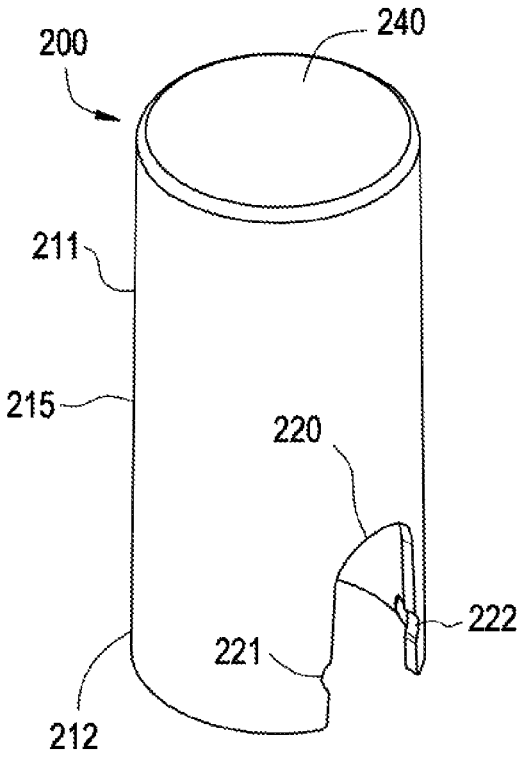
FIGS. 8A-8C are perspective (8A), side (8B), and cross-sectional (8C) views of an exemplary housing cap of the exemplary dispensing assembly of FIGS. 1-3B.
Figure 8B:
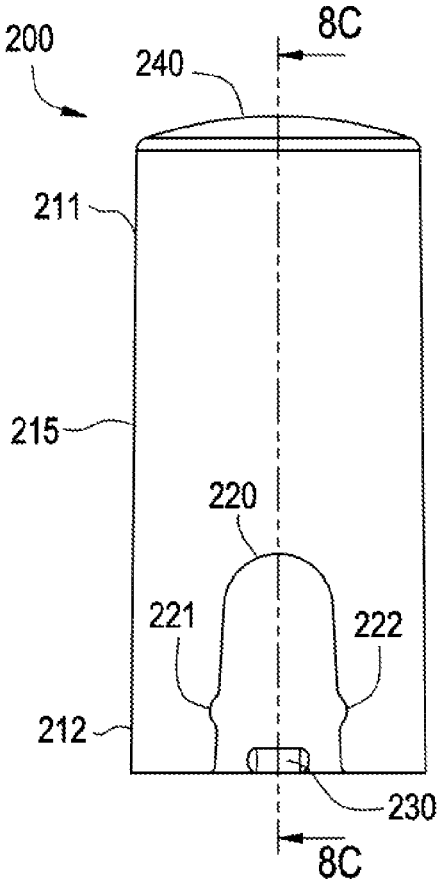
Figure 8C:
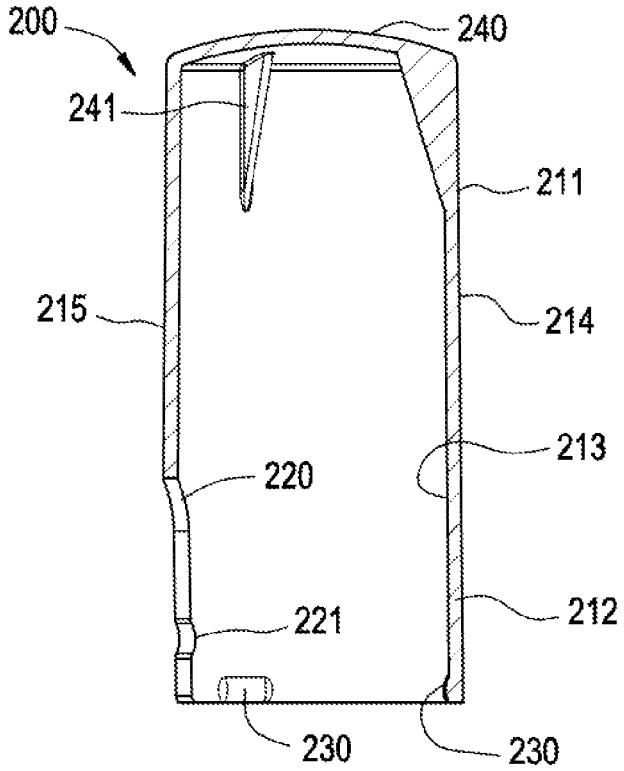
Figure 9A:
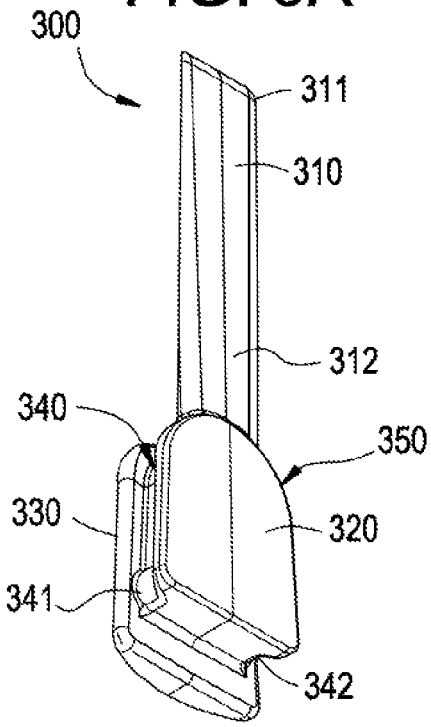
FIGS. 9A-9E are perspective (9A), back (9B), front (9C), side (9D), and cross-sectional (9E) views of an exemplary extracting tool of the exemplary dispensing assembly of FIGS. 1-3B.
Figure 9B:
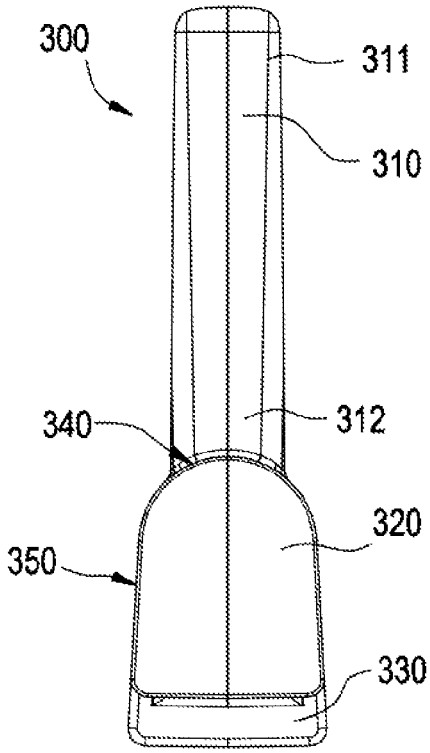
Figure 9C:
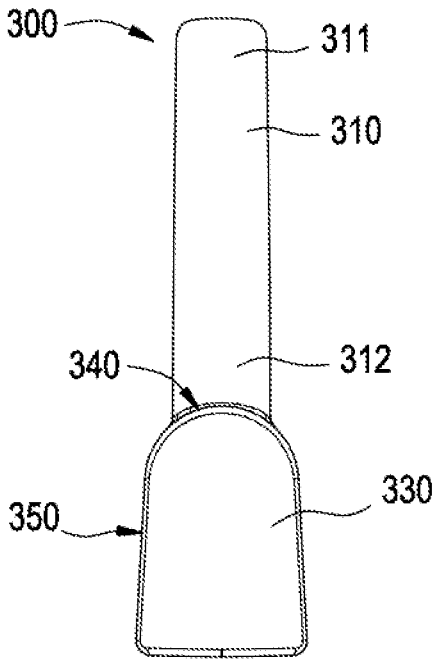
Figure 9D:
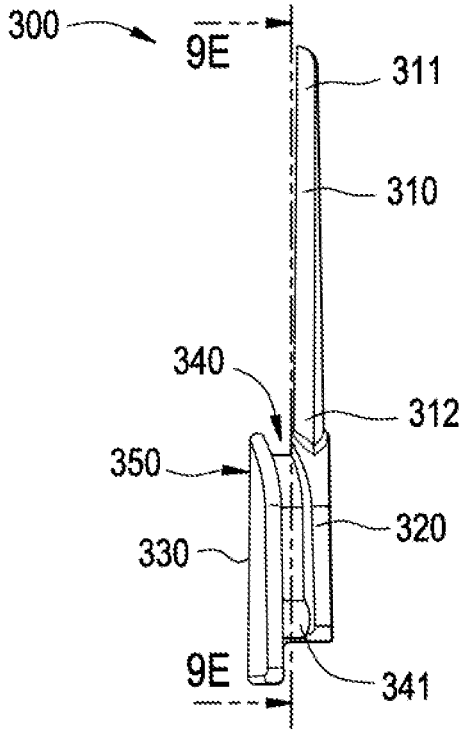
Figure 9E:
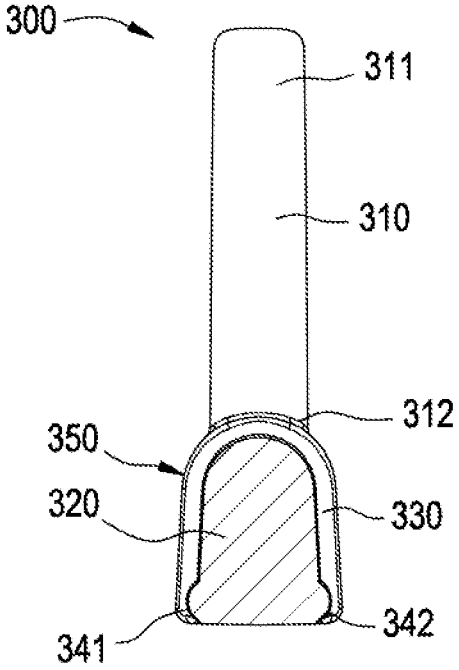

FIG. 1 is an exploded view of an exemplary dispensing assembly 10. FIGS. 2A-2C are perspective, side, and top views of the exemplary dispensing assembly 10 of FIG. 1. In one embodiment, the dispensing assembly 10 includes a housing base 100 (FIGS. 4A-4F), a housing cap 200 (FIGS. 8A-8C), an extracting tool 300 (FIGS. 9A-9E), an extracting tube 400 (FIGS. 5A-5D), a plunger 500 (FIGS. 6A-6B), and a housing base label 700. Although the dispensing assembly 10 is shown as a cylindrical structure with several cylindrical components, it will be understood that other shapes may be used, including square, ovular, etc. In one embodiment, the dispensing assembly is made of Acrylonitrile Butadiene (ABS) plastic. It will be understood that other materials can also be used.

As best shown in FIGS. 3A-4D, the housing base 100 includes a housing housing base wall 110 forming a perimeter of the housing base 100. The housing base wall 110 includes a top section 101, a bottom section 102, an inner surface 111, and an outer surface 112. It will be understood that any location or direction references herein to, e.g., "top," "bottom," "up," or "down," are made to facilitate explanation and understanding of the invention and are in reference to the figures, which show the dispensing assembly 10 right-side up. The housing base 100 also includes a guide tube 120 extending along a longitudinal axis 20 of the dispensing assembly 10. The guide tube 120 guides the plunger 500 (FIGS. 6A-6B) as the plunger 500 moves up and down within the dispensing assembly 10. The guide tube 120 includes a top section 121 and a bottom section 122. A first guide tube opening 126 is located at a top end of the top section 121 of the guide tube 120. In one embodiment, the guide tube 120 further includes a second guide tube opening 119 located at a bottom end of the bottom section 122 of the guide tube 120. The guide tube 120 also includes a first guide tube slot 123 extending longitudinally along at least a portion of the guide tube 120 and a second guide tube slot 124 extending longitudinally along at least a portion of the guide tube 120. In one embodiment, the second guide tube slot 124 is diametrically opposed to the first guide tube slot 123. It will be understood that a different number of guide slots can be used in other embodiments, including only one guide slot.

Figure 4A:
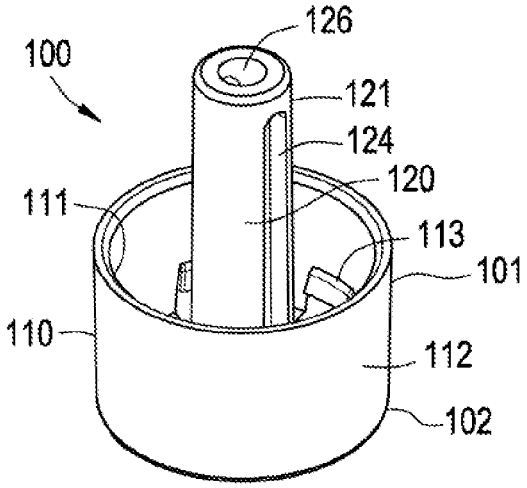
FIGS. 4A-4F are perspective (4A), side (4B, 4C), cross-sectional (4D), top (4E), and bottom (4F) views of an exemplary housing base of the exemplary dispensing assembly of FIGS. 1-3B.
Figure 4B:
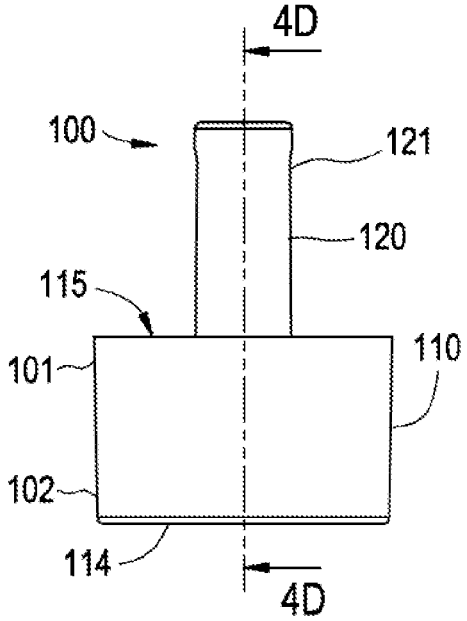
Figure 4C:
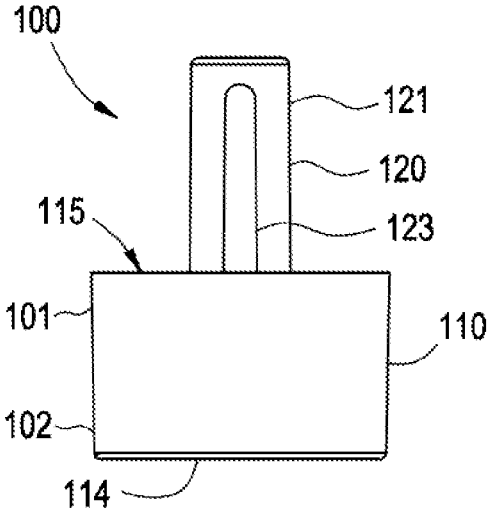
Figure 4D:
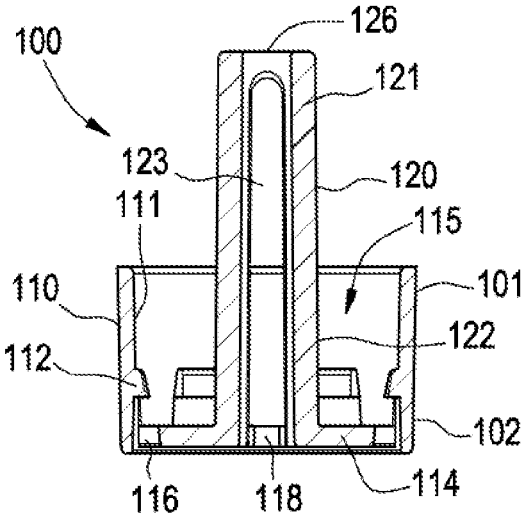
Figure 4E:
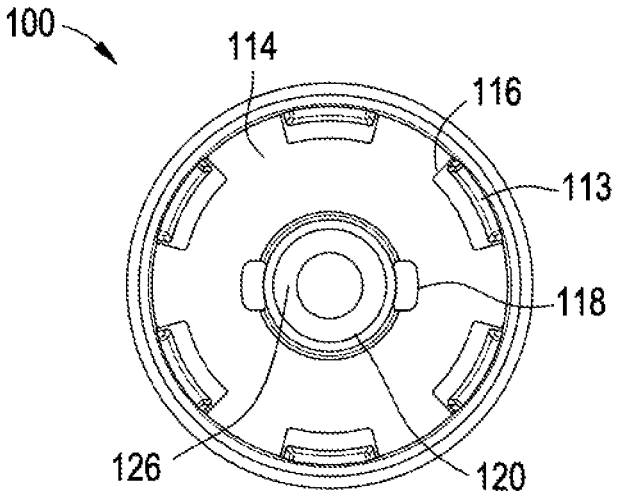
Figure 4F:
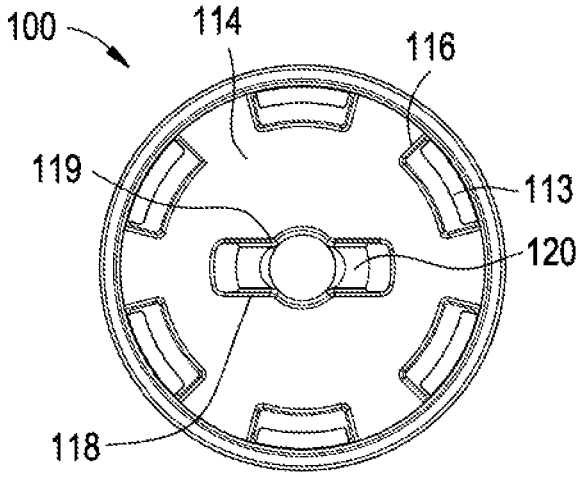
Figure 5A:
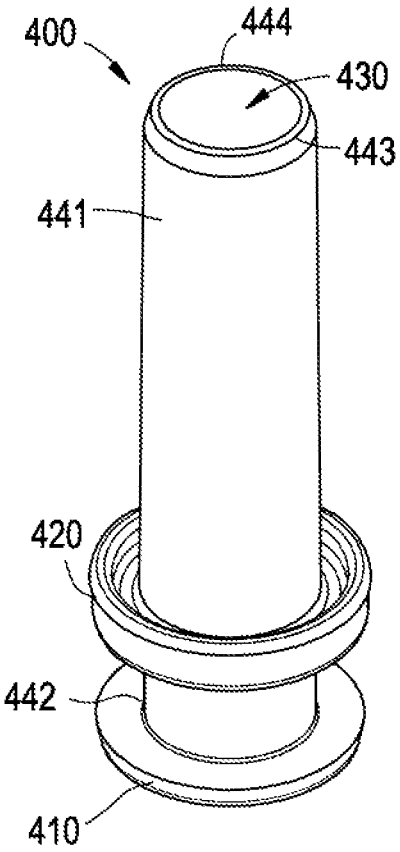
FIGS. 5A-5D are perspective (5A), side (5B), cross-sectional (5C), and bottom (5D) views of an exemplary extracting tube of the exemplary dispensing assembly of FIGS. 1-3B.
Figure 5B:
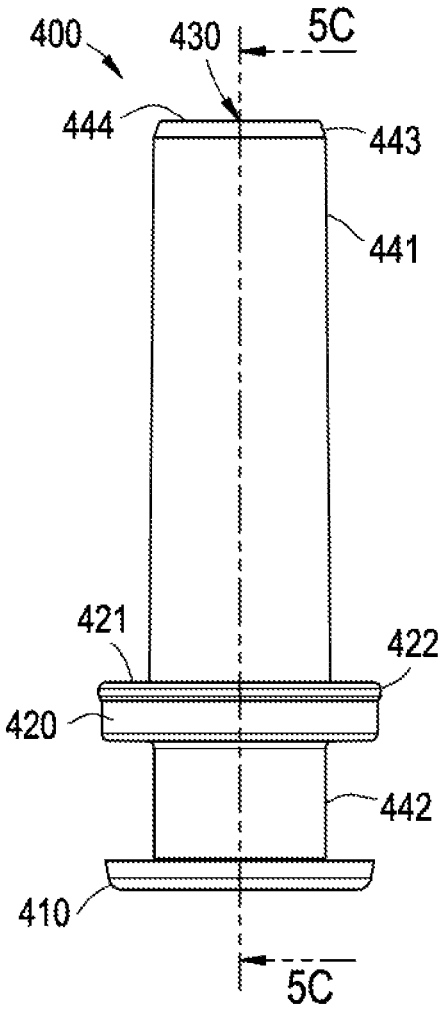
Figure 5C:
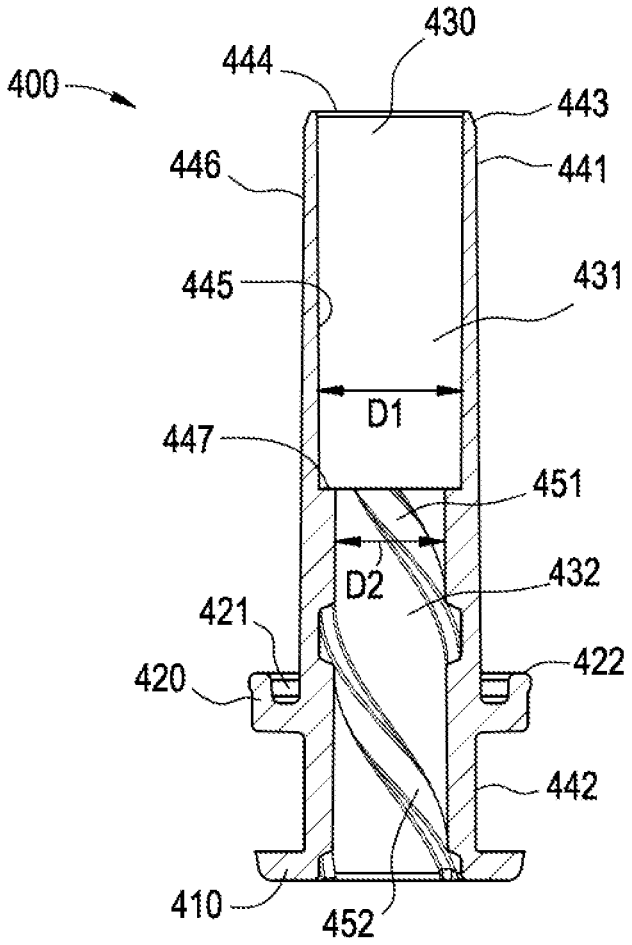
Figure 5D:
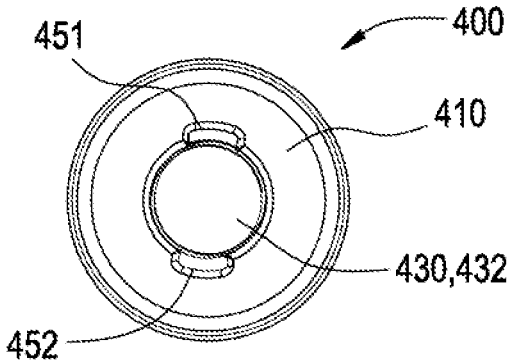

The housing base 100 also includes a housing base floor 114 extending from the bottom section 122 of the guide tube 120 to the bottom section 102 of the housing base wall 110. As shown in FIGS. 4E and 4F, the housing base floor 114 can include a plurality of openings 116 along the perimeter of the housing base floor 114. A housing base cavity 115 is formed between the inner surface 111 of the housing base wall 110, the housing base floor 114, and the guide tube 120. In one embodiment, the housing base 100 further includes a plurality of retention tabs 113 extending from the inner surface 111 of the bottom section 102 of the housing base wall 110 of the housing base 100. As will be explained, these retention tabs 113 rotatably engage the extracting tube 400. In one embodiment, a housing base label 700 or other device can be installed onto the bottom of the housing assembly 10 that can, e.g., be used for displaying the brand name of the dispensing assembly 10.

In one embodiment, the housing base 100 further includes a plunger slot 118 located in the housing base floor 114 and aligned with the second guide tube opening 119. The first guide tube slot 123 and the second guide tube slot 124 can extend longitudinally along at least a portion of the guide tube 120 to the bottom end of the bottom section 122 of the guide tube 120. In this configuration shown in FIGS. 3A and 3B, the plunger slot 118, the first guide tube slot 123, and the second guide tube slot 124 are configured to receive the plunger 500 inserted through the housing base floor 114 of the housing base 100.

As best shown in FIGS. 3A-3B and 5A-5D, the extracting tube 400 is partially located in the housing base cavity 115 and extends along the longitudinal axis 20 of the dispensing assembly 10. The extracting tube 400 is configured to receive a cosmetic stick by, e.g., being inserted into another cosmetic stick dispenser and at least partially surrounding the unused portion of the cosmetic stick. For example, the extracting tube space 430, which includes a top space section 431 and a bottom space section 432, can create a suction or other vacuum force when the extracting tube 400 surrounds the cosmetic stick, allowing the extracting tube 400 to extract some or all of the unused portion of the cosmetic stick from the other dispenser. In one embodiment, the top end of the top section 441 of the extracting tube 400 includes a tapered edge 443 to facilitate insertion into and extraction of the cosmetic stick from the other dispenser.

Figure 3A:
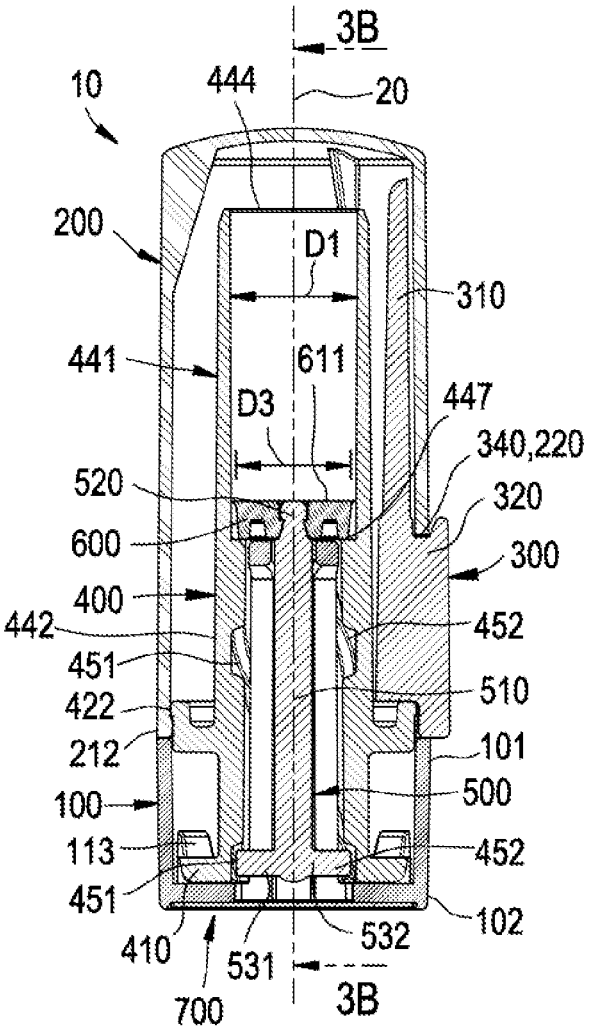
FIGS. 3A and 3B are cross-sectional views of the exemplary dispensing assembly of FIGS. 1 and 2 as assembled.
Figure 3B:
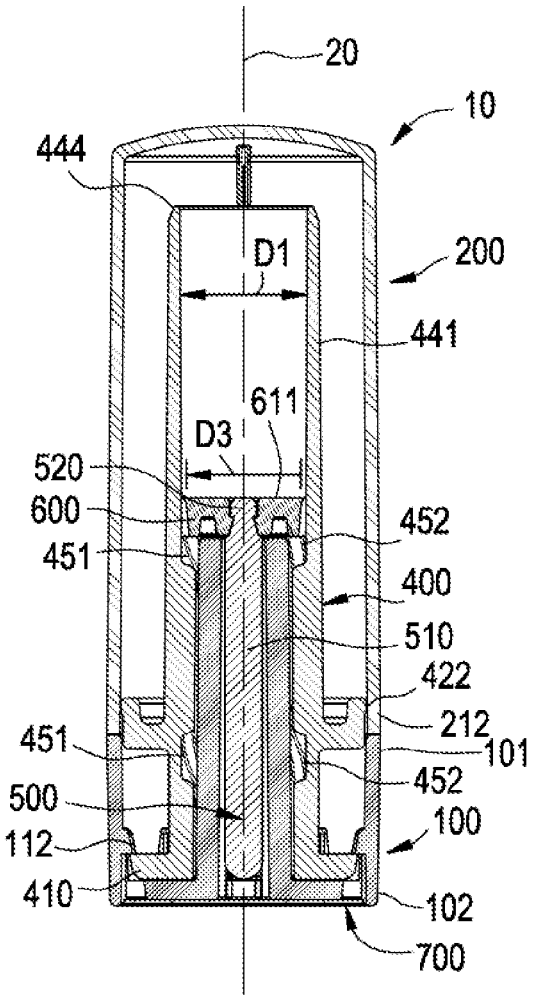

The extracting tube 400 includes an inner surface 445 and an outer surface 446, and a top section 441 and a bottom section 442. As shown in FIGS. 3A and 3B, the inner surface 445 of the bottom section 442 of the extracting tube 400 surrounds a portion of the first guide tube slot 123 and the second guide tube slot 124 of the guide tube 120. A first guide groove 451 extends helically along the inner surface 445 of at least a portion of the bottom section 442 of the extracting tube 400, while a second guide groove 452 extends helically along the inner surface 445 of at least a portion of the bottom section 442 of the extracting tube 400. In one embodiment, the second guide groove 452 is diametrically opposed to the first guide groove 451. It will be understood that a different number of guide grooves can be used in other embodiments, including only one guide groove.

The extracting tube 400 further includes a retention flange 410 extending radially from the bottom section 442 of the extracting tube 400. As shown in FIG. 3A, the plurality of retention tabs 113 of the housing base 100 are configured to rotatably engage the retention flange 410, allowing the extracting tube 400 to rotate with respect to the housing base 100. Accordingly, the extracting tube 400 is rotatably engaged with the housing base 100.

Figure 7A:
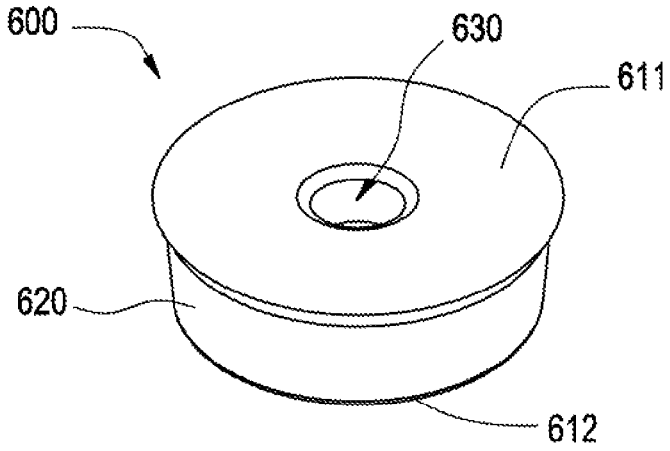
FIGS. 7A-7C are perspective (7A), side (7B), and cross-sectional (7C) views of an exemplary plunger cap of the exemplary dispensing assembly of FIGS. 1-3B.
Figure 7B:
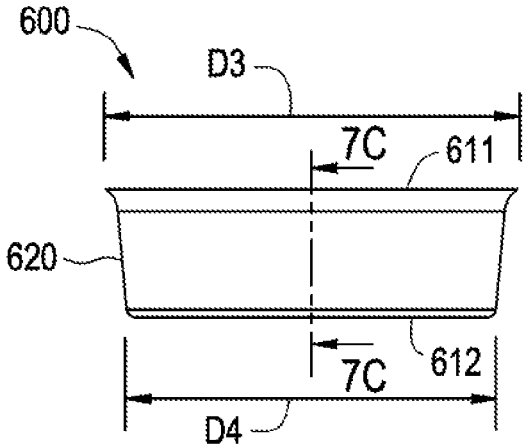

As best shown in FIGS. 3A, 3B, an 5C, in one embodiment, the inner diameter (D1) of the inner surface 445 of the top section 441 of the extracting tube 400 is greater than inner diameter (D2) of the inner surface 445 of the bottom section 442 of the extracting tube 400. A stop ledge 447 is formed between the inner surface 445 of the top section 441 of the extracting tube 400 and the inner surface 445 of the bottom section 442 of the extracting tube 400. As shown in FIG. 3A, the stop ledge 447 is configured to prevent the plunger cap 600 from entering the bottom section 442 of the extracting tube 400. For example, if the inner diameter of the stop ledge 447 is less than the outer diameter (D4) of bottom surface 612 of the plunger cap 600 (FIG. 7B), the plunge cap 600 cannot enter the bottom section 442 of the extracting tube 400. The stop ledge 447 can therefore prevent the bottom section 512 of the plunger 500 (FIGS. 3A-3B and 6A-6B) from exiting the bottom of the dispensing assembly 10.

In one embodiment, the extracting tube 400 also includes a housing cap retention ring 420. A channel 421 is formed in the housing cap retention ring 420. As shown in FIGS. 3A and 3B, the housing cap retention ring 420 includes a retention lip 421 configured to fit and engage with retention protrusion 230 of the housing cap 200 (FIGS. 8B and 8C) to detachably attach the housing cap 200 to the extracting tube 400. As used herein, the term detachably attach refers to engagement that is designed to be released when normal pressure is applied by hand by a user to disengage two components.

As best shown in FIGS. 3A-3B and 6A-6B, the plunger 500 is at least partially surrounded by the guide tube 120 and extends along the longitudinal axis 20 of the dispensing assembly 10. The plunger 500 includes a plunger stem 510 including a top section 511 and a bottom section 512. The bottom section 512 of the plunger stem 510 extends longitudinally through at least a portion of the guide tube 120. The top end of the top section 511 of the plunger stem 510 extends through the first guide tube opening 126 located at the top end of the top section 121 of the guide tube 120. In one embodiment, a first plunger guide pin 531 extends radially from the bottom section 512 of the plunger stem 510 through the first guide tube slot 123 of the guide tube 120 and into the first guide groove 451 of the extracting tube 400. A second plunger guide pin 532 extends radially from the bottom section 512 of the plunger stem 510 through the second guide tube slot 124 of the guide tube 120 and into the second guide groove 452 of the extracting tube 400. In one embodiment, the second plunger guide pin 532 is diametrically opposed to the first plunger guide pin 531. It will be understood that a different number of guide pins can be used in other embodiments, including only one guide pin.

In one embodiment, when the housing base 100 is rotated with respect to the extracting tube 400, the first plunger guide pin 531 is configured to move within the first guide tube slot 123 of the guide tube 120 as the first plunger guide pin 531 moves along the first guide groove 451 extending helically along the inner surface 445 of the bottom section 442 of the extracting tube 400. Similarly, when the housing base 100 is rotated with respect to the extracting tube 400, the second plunger guide pin 532 is configured to move within the second guide tube slot 124 of the guide tube 120 as the second plunger guide pin 532 moves along the second guide groove 452 extending helically along the inner surface 445 of the bottom section 442 of the extracting tube 400.

As best shown in FIGS. 3A-3B and 7A-7C, a plunger cap 600 includes a top surface 611, a bottom surface 612, and a side surface 620 connecting the top surface 611 and the bottom surface 612. The plunger cap 600 is located outside of the guide tube 120 at the top end of the top section 511 of the plunger stem 510 and is surrounded by the inner surface 445 of the top section 441 of the extracting tube 400. The movement of the first plunger guide pin 531 and the second plunger guide pin 532 is configured to move the plunger stem 510 and the plunger cap 600 longitudinally within the extracting tube 400 to push the cosmetic stick through the extracting tube 400 until a portion of the cosmetic stick is exposed at a top end of the top section 441 of the extracting tube 400. The top surface 611 of the plunger cap 600 can be substantially flush with a top edge 444 of the top section 441 of the extracting tube 400 when the housing base 100 is rotated (e.g., at a maximum) with respect to the extracting tube 400. This eliminates any unused or inaccessible portions of the cosmetic stick.

In one embodiment, in order to ensure that most or all of the cosmetic stick is pushed through the extracting tube 400, the outer diameter (D3) of the top surface 611 of plunger cap 600 is in the range of only 0.1 mm to 0.5 mm less than the inner diameter (D1) of the inner surface 445 of the top section 441 of the extracting tube 400 as shown in FIGS. 3A, 3B, 5C, and 7B. In one embodiment, the outer diameter (D3) of the top surface 611 of plunger cap 600 is 0.2 mm less than the inner diameter (D1) of the inner surface 445 of the top section 441 of the extracting tube 400.

Figure 7C:
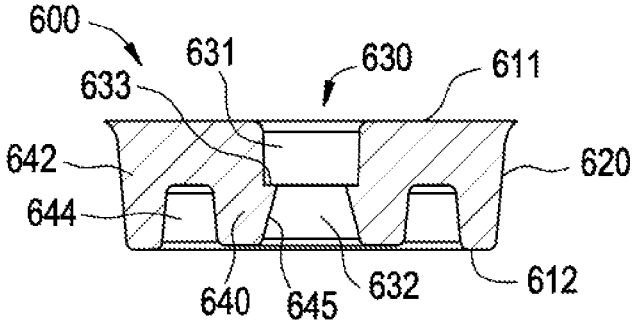

In one embodiment, the plunger cap 600 can be integrally attached to the plunger stem 510. In another embodiment and as shown in the figures, the plunger cap 600 is detachably attached to the top section 511 of the plunger stem 510 using, e.g., a snap fit connection. A shown in FIG. 6B, the top end of the top section 511 of the plunger stem 510 can include a retention protrusion 520 atop a tapered neck 522 that extends from the plunger stem 510. The interface between the retention protrusion 520 and the tapered neck 522 forms a retention edge 523 for securing the plunger cap 600. The retention protrusion 520 of the plunger 500 also includes a ramped surface 524 that engages the ramped surface 645 of the plunger cap 600 (as shown in FIGS. 3A, 3B, and 7C). In order to receive the retention protrusion 520 of the plunger 500, the plunger cap 600 includes an opening 630 made up of a top opening 631 and a bottom opening 632 with a step 633 formed between the two openings. In one embodiment, an inner ring 640 is formed on the bottom surface 612 of the plunger cap 600 and receives the retention protrusion 520. An annular space 644 formed between the inner ring 640 and an outer ring 644 on the bottom surface 612 of the plunger cap 600 allows the plunger cap 600 to snap fit over the retention protrusion 520, causing the step 633 of the plunger cap 600 to engage with the retention edge 523 of the plunger 500 as shown in FIGS. 3A, 3B, 6B, and 7C.

As best shown in FIGS. 3A-3B and 8A-8C, a housing cap 200 surrounds at least a portion of the extracting tube 400. The housing cap 200 includes a housing cap wall 215 forming a perimeter of the housing cap 200. The housing cap wall 215 includes a top section 211, a bottom section 212, an inner surface 213, and an outer surface 214. A housing cap top 240 sits atop the housing cap and is supported by a plurality of support ribs 241 attached to the inner surface 213 of the housing cap wall 215. An extracting tool receiving opening 220 is formed in the bottom section 212 of the housing cap wall 215. The extracting tool receiving opening 220 further includes a first groove 221 and a second groove 222 for engaging with the extracting tool 300.

As best shown in FIGS. 3A-3B and 9A-9E, an extracting tool 300 includes a probe stick 310 including a distal section 311 and a proximal section 312, and a gripping section 350 including an inner section 320 and an outer section 330. The extracting tool 300 can be used to extract any of the unused portion of the cosmetic stick from the other dispenser remaining after extraction by the extracting tube 400. In one embodiment, a gripping section channel 340 is formed between the inner section 320 and the outer section 330 of the gripping section 350. The gripping section channel 340 is configured to fit and engage with the extracting tool receiving opening 220 formed in the bottom section 212 of the housing cap wall 215. For example, the gripping section channel 340 further includes a first retention protrusion 341 and a second retention protrusion 342. The first groove 221 of the extracting tool receiving opening 220 of the housing cap 200 is configured to fit and engage with the first retention protrusion 341, while the second groove 222 is configured to fit and engage with the second retention protrusion 342 to detachably attach the extracting tool 300 to the housing cap 200. Once assembled together, the probe stick 310 of the extracting tool 300 conveniently extends within the housing cap 200 from the inner section 320 of the gripping section 350.

In one embodiment, since several of the components are detachable attached to each other, the components can be detached and cleaned, including cleaned in a dishwasher if suitable materials are used for the construction of the dispensing assembly 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An assembly for dispensing a cosmetic stick, the assembly comprising:

a housing base comprising a housing base wall forming a perimeter of the housing base, the housing base wall comprising a top section, a bottom section, an inner surface, and an outer surface, a guide tube extending along a longitudinal axis of the assembly, the guide tube comprising a top section and a bottom section, a first guide tube opening located at a top end of the top section of the guide tube, and a first guide tube slot extending longitudinally along at least a portion of the guide tube, a housing base floor extending from the bottom section of the guide tube to the bottom section of the housing base wall, wherein a housing base cavity is formed between the inner surface of the housing base wall, the housing base floor, and the guide tube;

an extracting tube at least partially located in the housing base cavity and extending along the longitudinal axis of the assembly, the extracting tube comprising an inner surface and an outer surface, a top section and a bottom section, wherein the inner surface of the bottom section of the extracting tube surrounds at least a portion of the first guide tube slot of the guide tube, and a first guide groove extending helically along the inner surface of at least a portion of the bottom section of the extracting tube, wherein the extracting tube is rotatably engaged with the housing base, and wherein the extracting tube is configured to receive the cosmetic stick; and a plunger at least partially surrounded by the guide tube and extending along the longitudinal axis of the assembly, the plunger comprising a plunger stem comprising a top section and a bottom section, wherein the bottom section of the plunger stem extends longitudinally through at least a portion of the guide tube, and wherein a top end of the top section of the plunger stem extends through the first guide tube opening located at the top end of the top section of the guide tube, a plunger cap comprising a top surface and a bottom surface, wherein the plunger cap is located outside of the guide tube at the top end of the top section of the plunger stem and is surrounded by the inner surface of the top section of the extracting tube, and a first plunger guide pin extending radially from the bottom section of the plunger stem through the first guide tube slot of the guide tube and into the first guide groove of the extracting tube, wherein the first plunger guide pin is configured to move within the first guide tube slot of the guide tube as the first plunger guide pin moves along the first guide groove extending helically along the inner surface of the bottom section of the extracting tube when the housing base is rotated with respect to the extracting tube, and wherein the movement of the first plunger guide pin is configured to move the plunger stem and the plunger cap longitudinally within the extracting tube to push the cosmetic stick through the extracting tube until a portion of the cosmetic stick is exposed at a top end of the top section of the extracting tube;

a housing cap surrounding at least a portion of the extracting tube, the housing cap comprising a housing cap wall forming a perimeter of the housing cap, the housing cap wall comprising a top section, a bottom section, an inner surface, and an outer surface, wherein an extracting tool receiving opening is formed in the bottom section of the housing cap wall, and an extracting tool comprising a probe stick comprising a distal section and a proximal section, and a gripping section comprising an inner section and an outer section, wherein a gripping section channel is formed between the inner section and the outer section, and wherein the gripping section channel is configured to fit and engage with the extracting tool receiving opening formed in the bottom section of the housing cap wall, wherein the probe stick extends within the housing cap from the inner section of the gripping section; and wherein the extracting tool receiving opening further comprises a first groove, the gripping section channel further comprises a first retention protrusion, and the first groove is configured to fit and engage with the first retention protrusion to detachably attach the extracting tool to the housing cap.

2. An assembly for dispensing a cosmetic stick, the assembly comprising:

a housing base comprising a housing base wall forming a perimeter of the housing base, the housing base wall comprising a top section, a bottom section, an inner surface, and an outer surface, a guide tube extending along a longitudinal axis of the assembly, the guide tube comprising a top section and a bottom section, a first guide tube opening located at a top end of the top section of the guide tube, and a first guide tube slot extending longitudinally along at least a portion of the guide tube, a housing base floor extending from the bottom section of the guide tube to the bottom section of the housing base wall, wherein a housing base cavity is formed between the inner surface of the housing base wall, the housing base floor, and the guide tube;

an extracting tube at least partially located in the housing base cavity and extending along the longitudinal axis of the assembly, the extracting tube comprising an inner surface and an outer surface, a top section and a bottom section, wherein the inner surface of the bottom section of the extracting tube surrounds at least a portion of the first guide tube slot of the guide tube, and a first guide groove extending helically along the inner surface of at least a portion of the bottom section of the extracting tube, wherein the extracting tube is rotatably engaged with the housing base, and wherein the extracting tube is configured to receive the cosmetic stick; and a plunger at least partially surrounded by the guide tube and extending along the longitudinal axis of the assembly, the plunger comprising a plunger stem comprising a top section and a bottom section, wherein the bottom section of the plunger stem extends longitudinally through at least a portion of the guide tube, and wherein a top end of the top section of the plunger stem extends through the first guide tube opening located at the top end of the top section of the guide tube, a plunger cap comprising a top surface and a bottom surface, wherein the plunger cap is located outside of the guide tube at the top end of the top section of the plunger stem and is surrounded by the inner surface of the top section of the extracting tube, and a first plunger guide pin extending radially from the bottom section of the plunger stem through the first guide tube slot of the guide tube and into the first guide groove of the extracting tube, wherein the first plunger guide pin is configured to move within the first guide tube slot of the guide tube as the first plunger guide pin moves along the first guide groove extending helically along the inner surface of the bottom section of the extracting tube when the housing base is rotated with respect to the extracting tube, wherein the movement of the first plunger guide pin is configured to move the plunger stem and the plunger cap longitudinally within the extracting tube to push the cosmetic stick through the extracting tube until a portion of the cosmetic stick is exposed at a top end of the top section of the extracting tube, and wherein the assembly is configured so that the top surface of the plunger cap can be substantially flush with a top edge of the top section of the extracting tube when the housing base is rotated with respect to the extracting tube.

3. An assembly for dispensing a cosmetic stick, the assembly comprising:

a housing base comprising a housing base wall forming a perimeter of the housing base, the housing base wall comprising a top section, a bottom section, an inner surface, and an outer surface, a guide tube extending along a longitudinal axis of the assembly, the guide tube comprising a top section and a bottom section, a first guide tube opening located at a top end of the top section of the guide tube, and a first guide tube slot extending longitudinally along at least a portion of the guide tube, a housing base floor extending from the bottom section of the guide tube to the bottom section of the housing base wall, wherein a housing base cavity is formed between the inner surface of the housing base wall, the housing base floor, and the guide tube;

an extracting tube at least partially located in the housing base cavity and extending along the longitudinal axis of the assembly, the extracting tube comprising an inner surface and an outer surface, a top section and a bottom section, wherein the inner surface of the bottom section of the extracting tube surrounds at least a portion of the first guide tube slot of the guide tube, and a first guide groove extending helically along the inner surface of at least a portion of the bottom section of the extracting tube, wherein the extracting tube is rotatably engaged with the housing base, and wherein the extracting tube is configured to receive the cosmetic stick; and a plunger at least partially surrounded by the guide tube and extending along the longitudinal axis of the assembly, the plunger comprising a plunger stem comprising a top section and a bottom section, wherein the bottom section of the plunger stem extends longitudinally through at least a portion of the guide tube, and wherein a top end of the top section of the plunger stem extends through the first guide tube opening located at the top end of the top section of the guide tube, a plunger cap comprising a top surface and a bottom surface, wherein the plunger cap is located outside of the guide tube at the top end of the top section of the plunger stem and is surrounded by the inner surface of the top section of the extracting tube, and a first plunger guide pin extending radially from the bottom section of the plunger stem through the first guide tube slot of the guide tube and into the first guide groove of the extracting tube, wherein the first plunger guide pin is configured to move within the first guide tube slot of the guide tube as the first plunger guide pin moves along the first guide groove extending helically along the inner surface of the bottom section of the extracting tube when the housing base is rotated with respect to the extracting tube, wherein the movement of the first plunger guide pin is configured to move the plunger stem and the plunger cap longitudinally within the extracting tube to push the cosmetic stick through the extracting tube until a portion of the cosmetic stick is exposed at a top end of the top section of the extracting tube, and wherein the outer diameter of the top surface of plunger cap is in the range of 0.1 mm to 0.5 mm less than the inner diameter of the inner surface of the top section of the extracting tube.

4. The assembly of claim 3, wherein the housing base further comprises a plurality of retention tabs extending from the inner surface of the bottom section of the housing base wall of the housing base, the extracting tube further comprises a retention flange extending radially from the bottom section of the extracting tube, and the plurality of retention tabs are configured to rotatably engage the retention flange.

5. The assembly of claim 3, wherein the guide tube further comprises a second guide tube opening located at a bottom end of the bottom section of the guide tube, the housing base further comprises a plunger slot located in the housing base floor and aligned with the second guide tube opening, the first guide tube slot extends longitudinally along at least a portion of the guide tube to the bottom end of the bottom section of the guide tube, and the plunger slot and the first guide tube slot are configured to receive the plunger inserted through the housing base floor of the housing base.

6. The assembly of claim 3, wherein the top end of the top section of the extracting tube comprises a tapered edge.

7. The assembly of claim 3, wherein the plunger cap is detachably attached to the top section of the plunger stem.

8. The assembly of claim 3, wherein the outer diameter of the top surface of plunger cap is 0.2 mm less than the inner diameter of the inner surface of the top section of the extracting tube.

9. The assembly of claim 3, wherein the guide tube further comprises a second guide tube slot extending longitudinally along at least a portion of the guide tube, the extracting tube further comprises a second guide groove extending helically along the inner surface of at least a portion of the bottom section of the extracting tube, the plunger further comprises a second plunger guide pin extending radially from the bottom section of the plunger stem through the second guide tube slot of the guide tube and into the second guide groove of the extracting tube, the second plunger guide pin is configured to move within the second guide tube slot of the guide tube as the second plunger guide pin moves along the second guide groove extending helically along the inner surface of the bottom section of the extracting tube when the housing base is rotated with respect to the extracting tube, and the movement of the second plunger guide pin is configured to move the plunger stem and the plunger cap longitudinally within the extracting tube to push the cosmetic stick through the extracting tube until a portion of the cosmetic stick is exposed at a top end of the top section of the extracting tube.

10. The assembly of claim 9, wherein the second guide tube slot is diametrically opposed to the first guide tube slot, the second guide groove is diametrically opposed to the first guide groove, and the second plunger guide pin is diametrically opposed to the first plunger guide pin.

11. An assembly for dispensing a cosmetic stick, the assembly comprising:

a housing base comprising a housing base wall forming a perimeter of the housing base, the housing base wall comprising a top section, a bottom section, an inner surface, and an outer surface, a guide tube extending along a longitudinal axis of the assembly, the guide tube comprising a top section and a bottom section, a first guide tube opening located at a top end of the top section of the guide tube, and a first guide tube slot extending longitudinally along at least a portion of the guide tube, a housing base floor extending from the bottom section of the guide tube to the bottom section of the housing base wall, wherein a housing base cavity is formed between the inner surface of the housing base wall, the housing base floor, and the guide tube;

an extracting tube at least partially located in the housing base cavity and extending along the longitudinal axis of the assembly, the extracting tube comprising an inner surface and an outer surface, a top section and a bottom section, wherein the inner surface of the bottom section of the extracting tube surrounds at least a portion of the first guide tube slot of the guide tube, and a first guide groove extending helically along the inner surface of at least a portion of the bottom section of the extracting tube, wherein the extracting tube is rotatably engaged with the housing base, and wherein the extracting tube is configured to receive the cosmetic stick; and a plunger at least partially surrounded by the guide tube and extending along the longitudinal axis of the assembly, the plunger comprising a plunger stem comprising a top section and a bottom section, wherein the bottom section of the plunger stem extends longitudinally through at least a portion of the guide tube, and wherein a top end of the top section of the plunger stem extends through the first guide tube opening located at the top end of the top section of the guide tube, a plunger cap comprising a top surface and a bottom surface, wherein the plunger cap is located outside of the guide tube at the top end of the top section of the plunger stem and is surrounded by the inner surface of the top section of the extracting tube, and a first plunger guide pin extending radially from the bottom section of the plunger stem through the first guide tube slot of the guide tube and into the first guide groove of the extracting tube, wherein the first plunger guide pin is configured to move within the first guide tube slot of the guide tube as the first plunger guide pin moves along the first guide groove extending helically along the inner surface of the bottom section of the extracting tube when the housing base is rotated with respect to the extracting tube, wherein the movement of the first plunger guide pin is configured to move the plunger stem and the plunger cap longitudinally within the extracting tube to push the cosmetic stick through the extracting tube until a portion of the cosmetic stick is exposed at a top end of the top section of the extracting tube, and wherein the inner diameter of the inner surface of the top section of the extracting tube is greater than inner diameter of the inner surface of the bottom section of the extracting tube.

12. The assembly of claim 11, wherein a stop ledge is formed between the inner surface of the top section of the extracting tube and the inner surface of the bottom section of the extracting tube, and the stop ledge is configured to prevent the plunger cap from entering the bottom section of the extracting tube.

13. An assembly for dispensing a cosmetic stick, the assembly comprising:

a housing base comprising a housing base wall forming a perimeter of the housing base, the housing base wall comprising a top section, a bottom section, an inner surface, and an outer surface, a guide tube extending along a longitudinal axis of the assembly, the guide tube comprising a top section and a bottom section, a first guide tube opening located at a top end of the top section of the guide tube, a first guide tube slot extending longitudinally along at least a portion of the guide tube, and a second guide tube slot extending longitudinally along at least a portion of the guide tube, a housing base floor extending from the bottom section of the guide tube to the bottom section of the housing base wall, wherein a housing base cavity is formed between the inner surface of the housing base wall, the housing base floor, and the guide tube;

an extracting tube at least partially located in the housing base cavity and extending along the longitudinal axis of the assembly, the extracting tube comprising an inner surface and an outer surface, a top section and a bottom section, wherein the inner surface of the bottom section of the extracting tube surrounds at least a portion of the first guide tube slot and the second guide tube slot of the guide tube, a first guide groove extending helically along the inner surface of at least a portion of the bottom section of the extracting tube, and a second guide groove extending helically along the inner surface of at least a portion of the bottom section of the extracting tube, wherein the extracting tube is rotatably engaged with the housing base, and wherein the extracting tube is configured to receive the cosmetic stick;

a plunger at least partially surrounded by the guide tube and extending along the longitudinal axis of the assembly, the plunger comprising a plunger stem comprising a top section and a bottom section, wherein the bottom section of the plunger stem extends longitudinally through at least a portion of the guide tube, and wherein a top end of the top section of the plunger stem extends through the first guide tube opening located at the top end of the top section of the guide tube, a plunger cap comprising a top surface and a bottom surface, wherein the plunger cap is located outside of the guide tube at the top end of the top section of the plunger stem and is surrounded by the inner surface of the top section of the extracting tube, a first plunger guide pin extending radially from the bottom section of the plunger stem through the first guide tube slot of the guide tube and into the first guide groove of the extracting tube, and a second plunger guide pin extending radially from the bottom section of the plunger stem through the second guide tube slot of the guide tube and into the second guide groove of the extracting tube, wherein the first plunger guide pin is configured to move within the first guide tube slot of the guide tube as the first plunger guide pin moves along the first guide groove extending helically along the inner surface of the bottom section of the extracting tube when the housing base is rotated with respect to the extracting tube, the second plunger guide pin is configured to move within the second guide tube slot of the guide tube as the second plunger guide pin moves along the second guide groove extending helically along the inner surface of the bottom section of the extracting tube when the housing base is rotated with respect to the extracting tube, wherein the movement of the first plunger guide pin and the second plunger guide pin is configured to move the plunger stem and the plunger cap longitudinally within the extracting tube to push the cosmetic stick through the extracting tube until a portion of the cosmetic stick is exposed at a top end of the top section of the extracting tube, wherein the outer diameter of the top surface of plunger cap is in the range of 0.1 mm to 0.5 mm less than the inner diameter of the inner surface of the top section of the extracting tube;

a housing cap surrounding at least a portion of the extracting tube, the housing cap comprising a housing cap wall forming a perimeter of the housing cap, the housing cap wall comprising a top section, a bottom section, an inner surface, and an outer surface, wherein an extracting tool receiving opening is formed in the bottom section of the housing cap wall, and an extracting tool comprising a probe stick comprising a distal section and a proximal section, and a gripping section comprising an inner section and an outer section, wherein a gripping section channel is formed between the inner section and the outer section, and wherein the gripping section channel is configured to fit and engage with the extracting tool receiving opening formed in the bottom section of the housing cap wall, wherein the probe stick extends within the housing cap from the inner section of the gripping section.

* * * * *